US011639696B2

(12) United States Patent
Nilsson et al.

(10) Patent No.: US 11,639,696 B2
(45) Date of Patent: May 2, 2023

(54) METHOD OF IDENTIFYING FAULTS IN THE OPERATION OF HYDRAULIC FUEL INJECTORS HAVING ACCELEROMETERS

(71) Applicant: DELPHI TECHNOLOGIES IP LIMITED, St. Michael (BB)

(72) Inventors: Andreas Nilsson, London (GB); Edward Williams, London (GB)

(73) Assignee: Delphi Technologies IP Limited

( * ) Notice: Subject to any disclaimer, the term of this patent is extended or adjusted under 35 U.S.C. 154(b) by 0 days.

(21) Appl. No.: 17/050,865

(22) PCT Filed: May 3, 2019

(86) PCT No.: PCT/EP2019/061380
§ 371 (c)(1),
(2) Date: Oct. 27, 2020

(87) PCT Pub. No.: WO2019/215033
PCT Pub. Date: Nov. 14, 2019

(65) Prior Publication Data

US 2021/0231074 A1 Jul. 29, 2021

(30) Foreign Application Priority Data

May 8, 2018 (GB) ..... 1807460

(51) Int. Cl.
*F02D 41/22* (2006.01)
*F02M 51/00* (2006.01)
(Continued)

(52) U.S. Cl.
CPC ..... *F02D 41/221* (2013.01); *F02M 51/00* (2013.01); *F02D 41/30* (2013.01); *F02D 2041/2055* (2013.01); *F02M 2200/241* (2013.01)

(58) Field of Classification Search
CPC ..... F02D 41/221; F02D 41/30; F02D 2041/2055; F02M 51/00; F02M 2200/241
(Continued)

(56) References Cited

U.S. PATENT DOCUMENTS 5,747,684 A * 5/1998 Pace ..... F02M 65/00 73/114.49
5,819,710 A * 10/1998 Huber ..... F02M 63/0036 123/498
(Continued)

FOREIGN PATENT DOCUMENTS

CN 103967678 A 8/2014
DE 102007045642 A1 4/2009
GB 2413850 A 11/2005

*Primary Examiner* — Logan M Kraft
*Assistant Examiner* — John D Bailey
(74) *Attorney, Agent, or Firm* — Joshua M. Haines

(57) ABSTRACT

A method of determining the nature of a fault in the operation of a hydraulic fuel injector includes sending an actuation pulse to an actuator of the injector, the actuation pulse being above the minimum drive pulse of the injector. The method also includes analyzing a signal from an accelerometer of the injector to determine if there is a high frequency vibration component subsequent to the end of the activation pulse. The method also includes determining the functionality of a needle control valve of the injector dependent on the outcome of analyzing the signal from the accelerometer.

18 Claims, 1 Drawing Sheet

(51) Int. Cl.
*F02D 41/30* (2006.01)
*F02D 41/20* (2006.01)

(58) Field of Classification Search
USPC ..... 123/478
See application file for complete search history.

(56) References Cited

U.S. PATENT DOCUMENTS 6,082,326 A * 7/2000 Schietecatte ..... F02D 41/3827 701/107
6,192,855 B1 * 2/2001 Schietecatte ..... F02D 41/403 123/299
6,283,108 B1 * 9/2001 Matsufuji ..... F02D 41/221 123/690
6,367,453 B1 * 4/2002 Igashira ..... F02M 63/0045 123/498
6,655,355 B2 * 12/2003 Kropp ..... F02M 61/205 239/96
6,684,857 B2 * 2/2004 Boecking ..... F02M 63/0045 239/96
6,928,986 B2 * 8/2005 Niethammer ..... F02M 57/025 239/96
7,331,329 B2 * 2/2008 Tian ..... F02M 47/027 123/446
7,866,575 B2 * 1/2011 Straub ..... F02M 47/027 239/88
7,971,802 B2 * 7/2011 Male ..... F02M 63/0045 239/96
8,078,389 B2 * 12/2011 Huang ..... G01M 15/08 123/406.24
8,108,131 B2 * 1/2012 Huang ..... F02D 35/027 123/406.27
9,291,138 B2 * 3/2016 Morris ..... F02M 61/161
9,429,093 B2 * 8/2016 Empacher ..... F02D 41/2467
9,822,744 B2 * 11/2017 Bimbenet ..... F02M 55/004
10,174,730 B2 * 1/2019 Harcombe ..... F02M 61/205
10,309,336 B2 * 6/2019 Mukaihara ..... F02D 41/221
10,662,913 B2 * 5/2020 Etlender ..... F02M 61/167
2008/0103628 A1 * 5/2008 Sato ..... F02M 61/14 138/37
2008/0228341 A1 * 9/2008 Orifij ..... F02D 41/402 701/31.4
2008/0272214 A1 * 11/2008 Male ..... F02M 45/12 239/533.3
2011/0251777 A1 * 10/2011 Farah ..... F02D 41/30 701/103
2016/0177855 A1 * 6/2016 Kusakabe ..... F02D 41/20 123/490
2016/0332337 A1 * 11/2016 Reuber ..... B29C 44/3442
2017/0234920 A1 * 8/2017 Nair ..... H01F 7/064 324/423
2018/0142655 A1 * 5/2018 Thomas ..... F02M 57/005

* cited by examiner

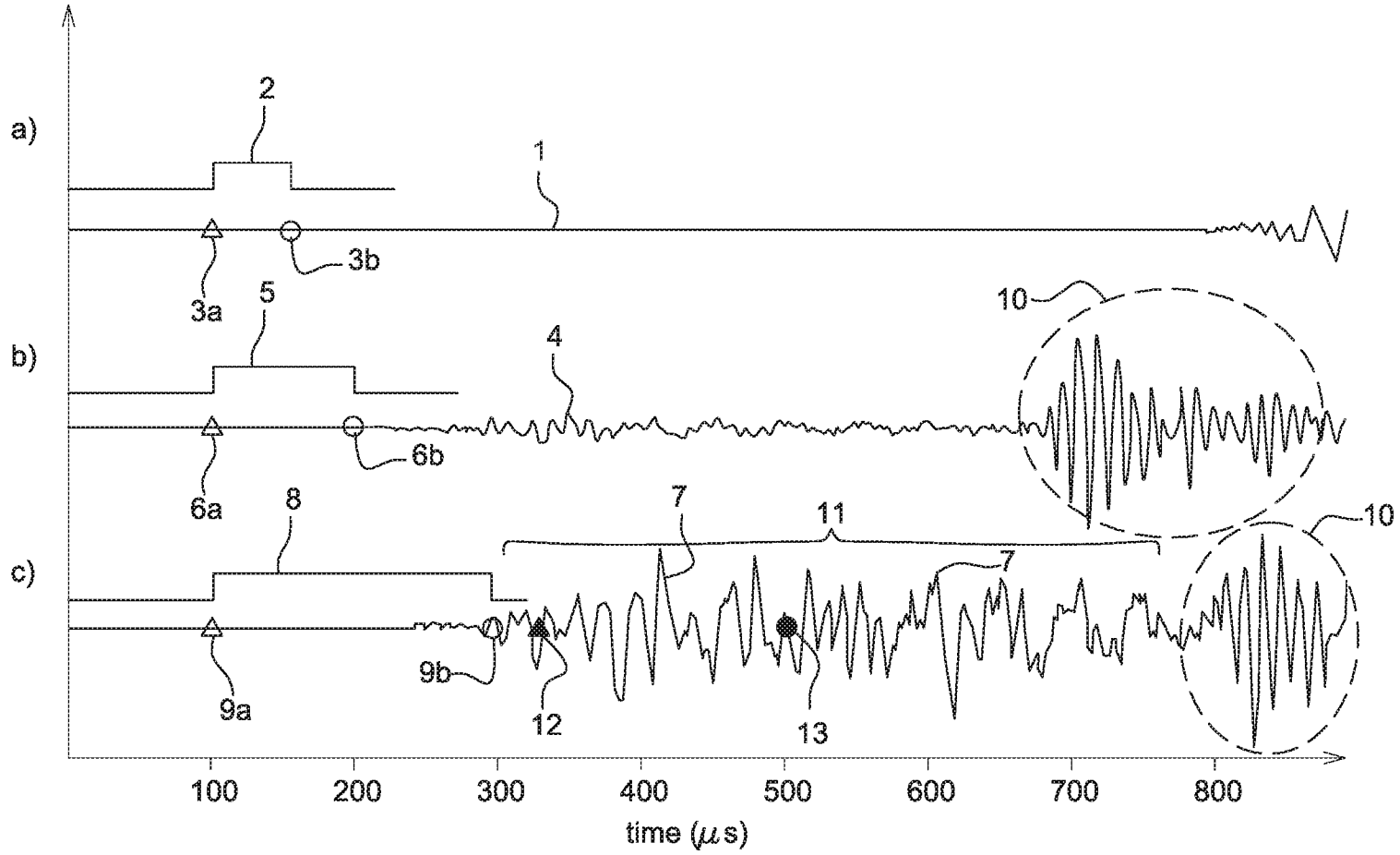
a)
b)
c)
1
2
3a
3b
4
5
6a
6b
7
8
9a
9b
10
11
12
13
100
200
300
400
500
600
700
800
time (μs)

METHOD OF IDENTIFYING FAULTS IN THE OPERATION OF HYDRAULIC FUEL INJECTORS HAVING ACCELEROMETERS

CROSS REFERENCE TO RELATED APPLICATIONS

This application is a national stage application under 35 USC 371 of PCT Application No. PCT/EP2019/061380 having an international filing date of May 3, 2019, which is designated in the United States and which claimed the benefit of GB Patent Application No. 1807460.9 filed on May 8, 2018, the entire disclosures of each are hereby incorporated by reference in their entirety.

TECHNICAL FIELD

This invention relates to hydraulically operated fuel injectors where an electrical actuator, such as a solenoid actuator, is used to operate a Needle Control Valve for the control of movement of a needle away from a valve seat. It has specific application to such injectors which also include an accelerometer (knock sensor) associated with them (e.g. located on, or adjacent to, the fuel injector).

BACKGROUND OF THE INVENTION

Typically hydraulically controlled fuel injectors have an actuator controlled valve (often referred to as a needle control valve (NCV)) adapted to be opened and closed by electrical actuator means such as a solenoid, so as to allow fuel to flow within the injector such that it forces a needle of a needle valve away from a valve seat to allow fuel to be injected under pressure into a combustion space.

If there is a fault in the operation of the injector there may be various possibilities of what has caused this, and the injector fails to inject. The fault could be due to the injector control valve (NCV) being stuck (e.g. in a closed position); the actuator being stuck, the needle of the needle valve being stuck, or the nozzle holes of the needle valve or needle control valve being blocked.

It is an object of the invention to determine such failures and also to distinguish between the types of failure which would save time and money repairing the injector.

SUMMARY OF THE INVENTION

In one aspect is provided a method A method of determining the nature of a fault in the operation of a hydraulic fuel injector, said injector including needle control valve (NCV), controlled by an electrical actuator, said needle control valve adapted to hydraulically control the movement of a needle of a needle valve to and away from a needle valve seat, and wherein said injector includes an accelerometer located on or adjacent to said fuel injector, comprising the steps of:

a) sending an actuation pulse to said actuator, said actuation pulse being above the minimum drive pulse of the injector;

b) analyzing the signal from said accelerometer to determine if there is a high frequency vibration component subsequent to the end of the activation pulse;

c) determining the functionality of the NCV dependent on the outcome of step b).

Step c) may comprise determining that there is a fault with the needle control valve if said high frequency vibration component is not detected and/or determining that there is no fault with the needle control valve if said high frequency vibration component is detected.

In step b) the portion of the signal analyzed is within said injection cycle of the fuel injector.

The method may including additionally determining if there is a misfire in the respective cylinder of the injector.

Step c) may comprise determining that there is a fault with the needle control valve if said high frequency vibration component is not detected and a misfire is detected.

If said high frequency vibration component is detected, the method may determine that there is a fault in the needle valve.

Step c) may comprise determining that there is a fault with the needle valve if said high frequency vibration component is detected and a misfire is detected.

The method may including additionally determining if there is a vibrational component having a low frequency component.

Said determination may comprise determining whether there is a vibrational component having a low frequency component immediately after end of the activation pulse or a predetermined period thereafter.

If said low frequency component is detected it may be concluded that the needle valve does not have a fault.

If said low frequency component is detected and there is a misfire, the method may determine that one or more orifices of the needle valve is blocked.

If said high frequency component is detected and said low frequency component is not detected then the method may determine that the needle valve is stuck.

Where determining if there is a vibrational component having a low frequency component may comprise, where said high frequency component is detected, determining there if said vibrational component having a low frequency component is detected between the end of the activation pulse and the start of said high frequency component.

Said high frequency component may be indicative of the NCV working and or said low frequency component is indicative the needle valve opening or closing.

Said high frequency or low frequency component may be identified by analyzing the amplitude, frequency, frequency spectra, and/or duration thereof.

The method may include filtering said signal to determine the presence of said high frequency signal.

Said high frequency wave activity may be generally in the range 65-75 kHz.

Said low frequency wave activity may be generally in the range may be between 15-50 KHz.

Said low the wave activity may be characterised by wave activity in the ranges 17-20 kHz range or 45-50 kHz range.

BRIEF DESCRIPTION OF THE DRAWINGS

The present invention is now described by way of example with reference to the accompanying drawings in which:

FIG. 1 shows the output signal of an accelerometer of an injector for three different actuations of an injector.

DESCRIPTION OF THE PREFERRED EMBODIMENTS

Typically advanced fuel injectors include accelerometers associated with them e.g. attached or integral with the fuel injector that provide raw signals or data to be fed to an ECU, or the signal therefrom processed by e.g. injector processor to provide processed data/parameters to the ECU. This allows operational parameters to be ascertained and used in the control of the injectors.

The invention uses data from such accelerometers (typically referred to as "knock sensors") to determine the aforementioned types of failure.

Solenoid actuated hydraulic fuel injectors are controlled by sending a drive (actuation) pulse to the solenoid. Often there is a Minimum Pulse Width required for any injection to take place, so if the drive pulse duration is less than this, it is too short to provide activation of injector components to provide injection. The longer the drive pulse is in duration, the longer the NCV is open and thus the longer the duration the needle is forced away from the valve seat, and consequently the more fuel is injected.

FIG. 1 shows the output signal of an accelerometer of an injector for three different actuations (actuation cycles) of an injector.

Section a) of FIG. 1 shows the signal 1 which results in no injection and no movement of the NCV because the actuation is too brief i.e. the drive pulse is too short e, g, below the minimum drive pulse duration. The drive pulse is shown by reference numeral 2. The points 3*a* and 3*b* are the start and end of the electrical pulse applied to actuate the injector Nozzle Control Valve respectively and can be regarded as start of logic and the end of logic in methodology. As can be seen, there is no vibration detected, just a very small amount detected a relatively long time after the end of the pulse.

Plot 4 shows the accelerometer signal for the case where there is (only) movement of the NCV, but no movement of the needle itself, i.e. the needle is stuck. Hence there is no injection. As can be seen, there is a component of relatively high frequency wave activity 10 in the signal which can be detected and which occurs some time after the end of the injection pulse. Plot 5 shows the corresponding drive pulse with corresponding start and end of the pulse with reference numerals 6*a* and 6*b* respectively.

Plot 7 show the case where both the NCV is working properly and as well as the needle valve (i.e. the needle is moving away and back to the valve seat during the injection cycle). Again plot 8 shows the actuation pulse and 9*a* and 9*b* the start and end points thereof. As can be seen there is detected a first wave activity 11 shortly after the end of the drive pulse. Again sometime after this, high frequency wave activity 10 is detectable—so a relatively longer time after the after injection, and after the end of the drive pulse. The start of injection and end of injection are shown by reference numeral 12 and 13 respectively. The first wave activity 11 is of significantly lower frequency than the high frequency wave activity. The frequencies of the low frequency wave activity is between 15-50 KHz: after the end of injection, the wave activity is characterised by wave activity in the 17-20 kHz range (so from point 13) and start of injection is in the 45-50 kHz range (so from point 12).

The high frequency wave activity 10 in plots 4 and 7 is related to NCV actuation, but is not dependent on the start and end times (e.g. duration) of the drive (actuation) pulse. This high frequency wave activity is due to cavitation in the spill path of the NCV and this phenomenon is not be present if the control valve (NCV) fails to open due to either a too short drive pulse (as in plot 1) or NCV failure. The characteristic high frequency wave activity is generally in the order of about 70 kHz; generally in the range 65-75 kHz.

The high frequency activity can be identified by its characteristics and determined by appropriate e.g. filtering or frequency analysis. The characteristics (such as amplitude, frequency, frequency spectra, duration, etc.) of this relatively high frequency waveform as well as the timing of it (e.g. in relation to other pulses of the start end times of the activation pulse) can be identified and characterised from e.g. test data. Thus this activity which is indicative of this "NCV working correctly" waveform can be identified for example by comparative methods. The skilled person would be aware of the various techniques in how this may be achieved.

Misfires, that is where there is no injection of fuel, can be detected by various means, and the skilled person would be aware of various methods of detecting a misfire in the engine. This can be done by e.g. looking at the engine crank speed, cylinder pressure sensor or exhaust temperatures or CL temperatures or such like.

If the characteristic high frequency "wave activity" is detected on an injector when a misfire (no injection) has been detected, according to methodology, it can be assumed the NCV has actuated properly, but the needle of the needle valve is not functional e.g. fails to lift, or the needle valve orifice (e.g. all holes thereof) are blocked. If no "high frequency wave activity" is present, the NCV has failed to open.

Example Method

In the following example it is assumed that the injector has an accelerometer associated with it but also processing capability such as a microprocessor (chip) enabling it process signal data and also communicated with an ECU. It is to be noted that functionality of the steps may be provided by the ECU or injector. In other examples the raw signal data may be sent to the ECU for analysis and processing.

Step 1: The engine controller ECU detects a misfire on a certain cylinder. This may be detected by various means. It may be detected by analyzing for example the accelerometer signal on the injector associated with the cylinder. Vibration which are normally detectably subsequent or consequent to injection (e.g. start and/or end of injection vibrations) being weak or missing.

Step 2: The engine controller sends a command to the injector of the cylinder to measure/analyse the signal of the accelerometer associated with the injector.

Step 3: The injector logic analyses the signal and where appropriates digitally filters the signal in order to detect whether there is any high frequency wave activity associated or occurring in an injection cycle.

Step 4: The injector then provides feedback from the measurement such as "high frequency wave activity" feedback (signal strength and timing)

Step 5: It is determined if the "high frequency" wave activity is detected i.e. if the signal is characteristic of this, but the vibrations for injection (e.g. signal for start/or end of injection) is weak or missing, the engine controller decides that the fault is related to the needle, not the control valve or the actuator.

This invention provides a mean for distinguishing between a stuck needle control valve or a stuck needle.

The invention claimed is:

1. A method of determining the nature of a fault in operation of a hydraulic fuel injector, said hydraulic fuel injector including a needle control valve which is controlled by an electrical actuator, said needle control valve configured to hydraulically control movement of a needle of a needle valve toward and away from a needle valve seat, wherein said hydraulic fuel injector includes an accelerometer located on or adjacent to said hydraulic fuel injector, said method comprising the steps of:

a) sending an actuation pulse to said electrical actuator, said actuation pulse being above a minimum drive pulse of the hydraulic fuel injector;

b) analyzing a signal from said accelerometer and determining if there is a high frequency vibration component subsequent to an end of the actuation pulse; and c) determining functionality of the needle control valve dependent on the analyzing of step b);

wherein step c) comprises determining that there is a fault with the needle control valve if said high frequency vibration component is not detected and/or determining that there is no fault with the needle control valve if said high frequency vibration component is detected.

2. A method as claimed in claim 1, wherein in step b) the signal is within an injection cycle of the hydraulic fuel injector.

3. A method as claimed in claim 1, further comprising determining if there is a misfire in a respective cylinder corresponding to the hydraulic fuel injector.

4. A method as claimed in claim 1, further comprising determining if there is a vibrational component having a low frequency component.

5. A method of determining the nature of a fault in operation of a hydraulic fuel injector, said hydraulic fuel injector including a needle control valve which is controlled by an electrical actuator, said needle control valve configured to hydraulically control movement of a needle of a needle valve toward and away from a needle valve seat, wherein said hydraulic fuel injector includes an accelerometer located on or adjacent to said hydraulic fuel injector, said method comprising the steps of:

a) sending an actuation pulse to said electrical actuator, said actuation pulse being above a minimum drive pulse of the hydraulic fuel injector;

b) analyzing a signal from said accelerometer and determining if there is a high frequency vibration component subsequent to an end of the actuation pulse;

c) determining functionality of the needle control valve dependent on the analyzing of step b); and determining if there is a misfire in a respective cylinder corresponding to the hydraulic fuel injector;

wherein step c) comprises determining that there is a fault with the needle control valve if said high frequency vibration component is not detected and a misfire is detected.

6. A method of determining the nature of a fault in operation of a hydraulic fuel injector, said hydraulic fuel injector including a needle control valve which is controlled by an electrical actuator, said needle control valve configured to hydraulically control movement of a needle of a needle valve toward and away from a needle valve seat, wherein said hydraulic fuel injector includes an accelerometer located on or adjacent to said hydraulic fuel injector, said method comprising the steps of:

a) sending an actuation pulse to said electrical actuator, said actuation pulse being above a minimum drive pulse of the hydraulic fuel injector;

b) analyzing a signal from said accelerometer and determining if there is a high frequency vibration component subsequent to an end of the actuation pulse; and c) determining functionality of the needle control valve dependent on the analyzing of step b);

wherein if said high frequency vibration component is detected, determining that there is a fault in the needle valve.

7. A method of determining the nature of a fault in operation of a hydraulic fuel injector, said hydraulic fuel injector including a needle control valve which is controlled by an electrical actuator, said needle control valve configured to hydraulically control movement of a needle of a needle valve toward and away from a needle valve seat, wherein said hydraulic fuel injector includes an accelerometer located on or adjacent to said hydraulic fuel injector, said method comprising the steps of:

a) sending an actuation pulse to said electrical actuator, said actuation pulse being above a minimum drive pulse of the hydraulic fuel injector;

b) analyzing a signal from said accelerometer and determining if there is a high frequency vibration component subsequent to an end of the actuation pulse; and c) determining functionality of the needle control valve dependent on the analyzing of step b);

wherein step c) comprises determining that there is a fault with the needle valve if said high frequency vibration component is detected and a misfire is detected.

8. A method as claimed in claim 7, further comprising determining whether there is a vibrational component having a low frequency component immediately after the end of the actuation pulse or a predetermined period thereafter.

9. A method as claimed in claim 8, wherein said high frequency component or said low frequency component is identified by analyzing amplitude, frequency, frequency spectra, and/or duration thereof.

10. A method as claimed in claim 9, further comprising filtering said signal to determine presence of said high frequency signal.

11. A method as claimed in claim 8, wherein if said low frequency component is detected, concluding that the needle valve does not have a fault.

12. A method as claimed in claim 8, wherein if said low frequency component is detected and there is a misfire, determining that one or more orifices of the needle valve is blocked.

13. A method as claimed in claim 8, wherein if said high frequency component is detected and said low frequency component is not detected, then determining that the needle valve is stuck.

14. A method as claimed in claim 8, wherein determining if there is a vibrational component having a low frequency component comprises: where said high frequency component is detected, determining if said vibrational component having a low frequency component is detected between the end of the actuation pulse and a start of said high frequency component.

15. A method as claimed claim 8, wherein said high frequency component is indicative of the needle control valve working and/or said low frequency component is indicative the needle valve opening or closing.

16. A method as claimed in claim 8, wherein said low frequency component is characterised by wave activity in a range of 17-20 kHz range or 45-50 kHz range.

17. A method as claimed in claim 8, wherein said low frequency component is in a range of 15-50 KHz.

18. A method of determining the nature of a fault in operation of a hydraulic fuel injector, said hydraulic fuel injector including a needle control valve which is controlled by an electrical actuator, said needle control valve configured to hydraulically control movement of a needle of a needle valve toward and away from a needle valve seat, wherein said hydraulic fuel injector includes an accelerometer located on or adjacent to said hydraulic fuel injector, said method comprising the steps of:

a) sending an actuation pulse to said electrical actuator, said actuation pulse being above a minimum drive pulse of the hydraulic fuel injector;

b) analyzing a signal from said accelerometer and determining if there is a high frequency vibration component subsequent to an end of the actuation pulse; and c) determining functionality of the needle control valve dependent on the analyzing of step b);

wherein said high frequency component is generally in a range 65-75 kHz.

* * * * *